United States Patent [19]

Ficke

[11] Patent Number: 4,717,125

[45] Date of Patent: Jan. 5, 1988

[54] METALLURGICAL LADLE WITH IMPROVED TILTING LUG

[75] Inventor: John D. Ficke, Union, Mo.

[73] Assignee: National Steel Corporation, Pittsburgh, Pa.

[21] Appl. No.: 838,497

[22] Filed: Mar. 11, 1986

[51] Int. Cl.[4] ..... C21B 3/00

[52] U.S. Cl. ..... 266/143; 266/274; 222/604

[58] Field of Search ..... 266/143, 240, 274; 222/164, 604, 166; 294/68.26

[56] References Cited

U.S. PATENT DOCUMENTS

| | | | |
|---|---|---|---|
| 2,881,488 | 4/1959 | Schweinberg | 222/164 |
| 2,910,746 | 11/1959 | Schweinberg | 222/164 |
| 3,047,916 | 8/1962 | O'Brien | 294/68.26 |
| 3,087,212 | 4/1963 | Burch | 222/604 |
| 3,550,816 | 12/1970 | Smith | 222/166 |
| 3,819,161 | 6/1974 | Hubatsch | 266/143 |

*Primary Examiner*—L. Dewayne Rutledge
*Assistant Examiner*—S. Kastler
*Attorney, Agent, or Firm*—O'Neil and Bean

[57] ABSTRACT

An improved tilting lug assembly for a metallurgical ladle includes an elongated hooking link having one end portion pivotally mounted on the sidewall of the ladle by a rigid support bracket positioned substantially 90° circumferentially from the ladle trunion axis, with an open eye on the other end of the hooking link. The hooking link is normally biased to a substantially horizontal position with the open eye projecting outwardly from the ladle sidewall in position to be easily engaged by the lifting hook of a crane for tilting the ladle, with the link being freely pivotable in an upward direction on application on an upwardly directed force and being pivoted downward from the normal horizontal position against the biasing means upon application of a downward force whereby engagement of the hooking link with an obstruction during raising or lowering the crane will not result in inadvertent tilting of the ladle.

8 Claims, 5 Drawing Figures

FIG.1
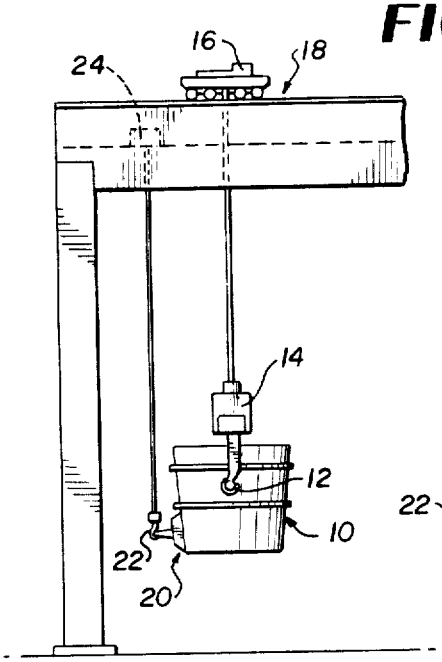
FIG.2
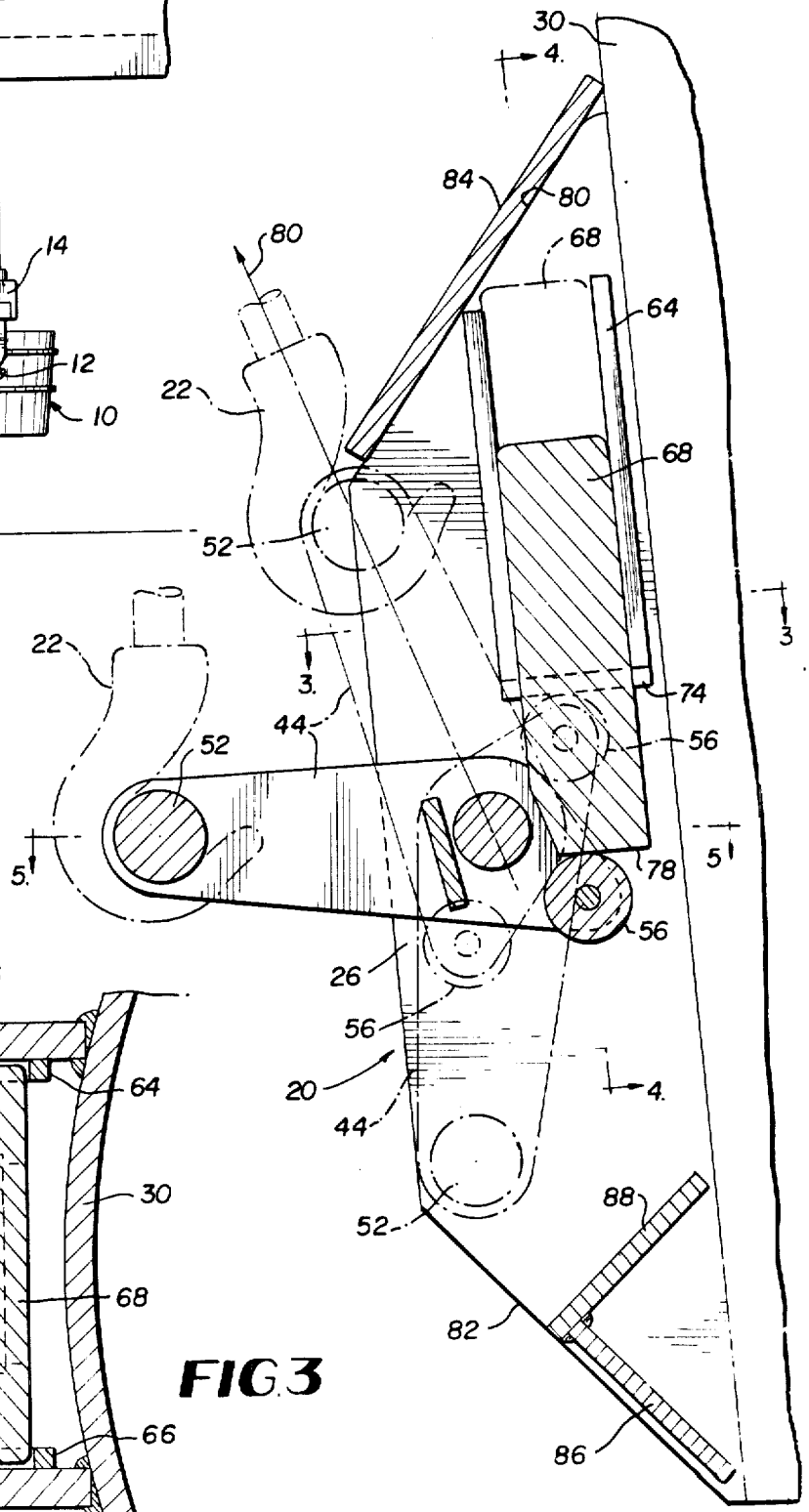
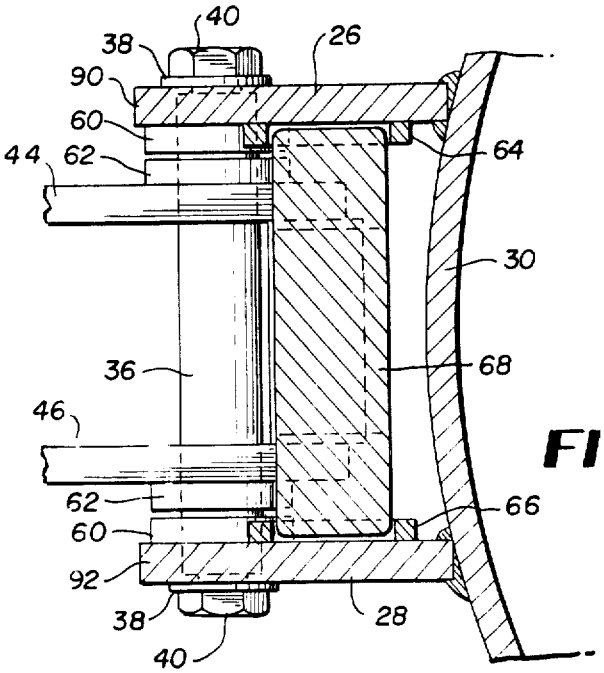
FIG.3

METALLURGICAL LADLE WITH IMPROVED TILTING LUG

BACKGROUND OF THE INVENTION

1. Field of the Invention

This invention relates to metallurgical ladles employed in the transfer of molten metal and more particularly to such a ladle having an improved tilting lug assembly for engagement by the lifting hook of a crane to tilt the ladle about its trunion axis.

2. Description of the Prior Art

A metallurgical ladle of the type employed for example in the steel industry to transfer hot metal to a metallurgical furnace or to transfer molten steel from the furnace to a continuous caster or ingot casting operation is conventionally suspended during movement by its trunions from the hooks of a main travelling crane hoist. The trunions and crane hooks also provide a pivotal axis about which the ladle can be tilted to teem the molten metal or to dump slag. To tilt the ladle, an auxiliary crane engages a tilting lug located on the outer sidewall of the ladle at a position approximately 90° from the trunion axis.

The prior art tilting lugs conventionally include a hooking link when not engaged by the auxiliary crane the side of the ladle in position to be engaged by the hook of the auxiliary crane. The link is pivoted at its end opposite the eye either to a rigid support bracket on the sidewall of the ladle or to a chain or other linkage mechanism to a lug on the bottom of the ladle. A bracket on the side of the ladle normally releasably supports the hooking link when not engaged by the auxillary crane hook.

The tilting lugs of the prior art metallurgical ladles generally have included some rigid structure projecting laterally from the ladle sidewall which can engage and be caught on an obstructing structure while the ladle is being manipulated by the crane. For example, in positioning such a ladle on the support station of a slag skimmer, if the ladle is not precisely positioned as it is lowered, the rigid tilting lug structure can strike supporting frame members and cause slag and/or molten steel to splash over the ladle rim. Similarly, in lifting the ladle from the slag skimmer the prior art hooking link or other portions of the tilting lug structure can strike and be caught upon an obstruction, again with the danger of tilting the ladle and spilling a portion of the contents. The spilling of molten metal not only presents a hazard to personnel, but also can damage auxiliary equipment and cause substantial loss due to repairs and down time.

It is an object of the present invention to provide an improved metallurgical ladle which avoids the shortcomings of the prior art ladles outlined above.

A further object of the invention is to provide an improved metallurgical ladle having a tilting lug mounted on one sidewall and including a hooking link normally projecting substantially horizontally from the ladle sidewall and being pivoted for tilting movement both upwardly and downwardly upon engaging an obstruction during lowering or lifting whereby the danger of inadvertent tilting of the ladle and spilling of the contents is greatly reduced.

A further object of the invention is to provide such a tilting arrangement wherein the pivoted hooking link is supported by a rigid bracket structure mounted on the ladle sidewall, which bracket structure is provided with upper and lower end portions inclined outwardly from the ladle sidewall to preclude the bracket from becoming caught on an obstruction.

Another object is to provide such a ladle in which the hooking link is pivotally mounted on a rigid bracket structure and normally biased to a generally horizontal position for ease of engagement by an auxiliary crane hook and which hooking link may be pivoted either upwardly or downwardly upon engaging an obstruction during lifting or lowering the ladle.

SUMMARY OF THE INVENTION

The foregoing and other features and advantages are achieved in accordance with the present invention in which a metallurgical ladle includes a tilting lug assembly rigidly mounted on the outer sidewall of the ladle for engagement by an auxillary crane hook to tilt the ladle about its trunion axis. The tilting assembly includes an elongated hooking link having one end portion mounted for free pivotal movement about a horizontal axis on the sidewall of the ladle by a rigid bracket assembly, and having an open eye at its other end for engagement by the hook of an auxiliary crane. The hooking link is biased to a substantially horizontal position so that the eye is readily engageable by the crane hook.

The hooking link is movable about its pivot axis both upward and downward so that in the event it engages an obstruction either during lifting or lowering the ladle, it is free to swing clear of the obstruction without tilting the ladle. The rigid bracket assembly supporting the hooking link is provided with inclined cam surfaces at its upper and lower ends whereby any obstruction encountered by the bracket will cause the ladle to be cammed or shifted slightly in a horizontal direction on the crane support cable, again without tilting the ladle or causing molten metal or slag to spill over the open top of the ladle.

BRIEF DESCRIPTION OF THE DRAWINGS

Other features and advantages of the invention will be apparent from the detailed description contained hereinbelow, taken in conjunction with the drawings, in which:

FIG. 1 is a schematic view of a metallurgical ladle embodying the present invention and supported by a travelling crane;

FIG. 2 is an enlarged view, partially in section, of a portion of the ladle shown in FIG. 1;

FIG. 3 is a sectional view taken on line 3—3 of FIG. 2;

DESCRIPTION OF THE PREFERRED EMBODIMENT

Figure 4:
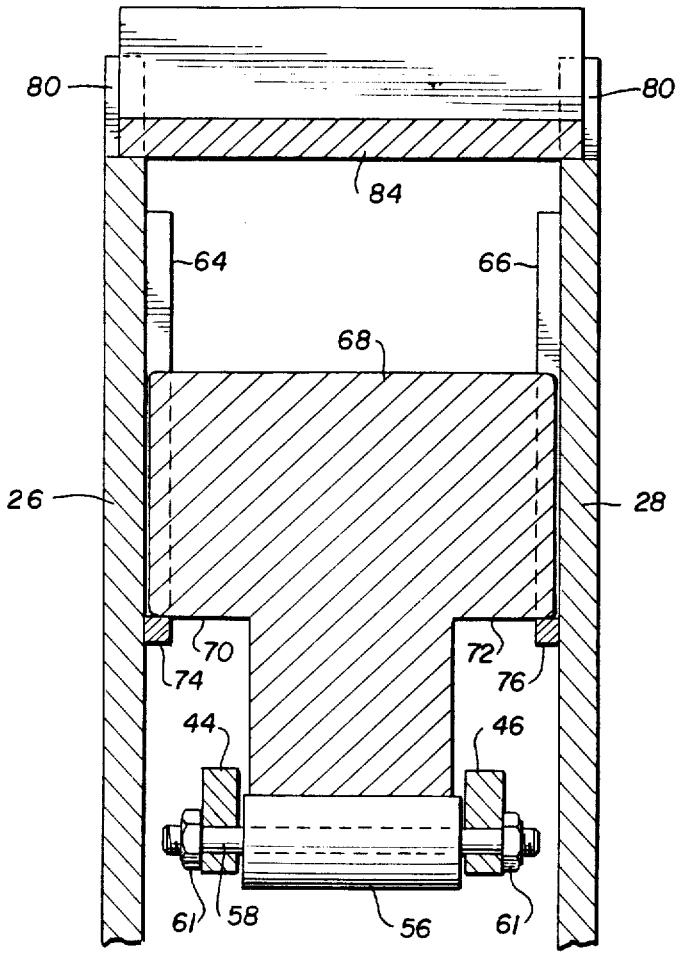
FIG. 4 is a sectional view taken on line 4—4 of FIG. 2.

Referring now to the drawings in detail, a refractory lined metallurgical ladle indicated generally by the reference numeral 10 is illustrated in FIG. 1 as being suspended by its trunions 12 by a bale assembly 14 from the main hoist 16 of a travelling crane assembly 18. A tilting lug assembly indicated generally at 20 is mounted on the outer sidewall of ladle 10 adjacent its bottom and at a location approximately 90° around the ladle from the axis of trunions 12. Tilting lug assembly 20 is shown in FIG. 1 as being connected to the hook 22 of an auxiliary hoist 24 on the travelling crane 18 whereby lifting the hook 22 can tilt, or pivot the ladle 10 about its trunion axis in the conventional manner.

Figure 5:
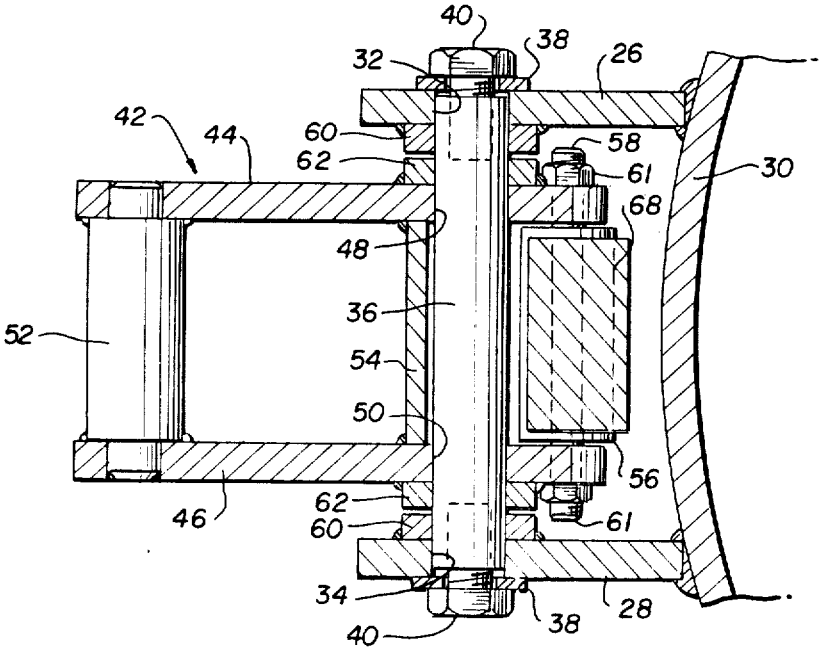
FIG. 5 is a sectional view taken on line 5—5 of FIG. 2.

Referring now to FIGS. 2-5, tilting lug assembly 20 includes a pair of bracket plates 26, 28 rigidly welded in parallel, circumferentially spaced relation to one another on the outer steel shell 30 of the sidewall of ladle 10. Openings 32, 34 formed in plates 26, 28, respectively, support a pivot shaft 36 in fixed outwardly spaced relation to sidewall 30, and suitable means such as washers 38 and bolts 40 retain the shaft in position.

A hooking link assembly 42 is pivotally mounted between plates 26, 28 on shaft 36 for limited free rotation about the horizontal axis of the shaft. Hooking link 42 comprises a pair of parallel spaced elongated arm members 44, 46 having openings 48, 50, respectively, formed therein for receiving the shaft 36. Arms 44, 46 are retained in spaced parallel relation by a pin 52 rigidly joined to the outwardly projecting ends of the arms and by a spacer plate 54. Arms 44, 46 and pin 52 cooperate to form an open end or lifting eye for receiving a crane hook. A roller 56 is mounted for free rotation on a shaft 58 extending between arms 44, 46 adjacent the end thereof opposite the pin 52, with shaft 58 and pin 52 extending in parallel relation to the shaft 36. Spacer members 60 rigidly welded on the opposing surfaces of plates 26, 28 cooperate with spacers 62 rigidly welded on the outwardly directed surfaces of arms 44, 46 to retain the link assembly centrally located on shaft 36. Suitable means such as nuts 61 retain shaft 58 on the assembly.

A first upwardly open, generally U-shaped guide track 64 is rigidly mounted on the inner surface of bracket plate 26 and a second similar guide track 66 is mounted on the inner surface of plate 28 in opposed relation to guide track 64. A generally T-shaped metal counterweight 68 is slidably received within the open top of tracks 64, 66, with shoulders 70, 72, respectively, normally engaging the closed bottoms 74, 76, respectively, of tracks 64, 66 to limit downward movement of counterweight 68. The bottom surface 78 of counterweight 68 normally engages roller 56 to bias the link assembly 42 to the substantially horizontal full line position shown in FIG. 2. In this normal position, the hooking link 42 presents pin 52 in the position most easily engaged by the hook 22 of the auxillary hoist 24.

When a lifting force is applied to hook 22 by hoist 24, link assembly 42 will be pivoted about shaft 36 to the upper broken line position shown in FIG. 2 so that the line of action of the hoist 24 indicated by arrow 80 extends through the axis of shaft 36. In this position, roller 56 is spaced below the bottom surface 78 of counterweight 68 and the counterweight is supported by its shoulders 70, 72 resting upon the bottom portions 74, 76, respectively, of the U-shaped tracks 64, 66. When auxiliary hoist 24 is lowered, link 42 will pivot, under influence of its own weight, about shaft 36 until roller 56 again contacts the bottom surface 78 of counterweight 68 at the full line position of the link shown in FIG. 2.

When the ladle 10 is being lifted, lowered, or transported by main hoist 16, the hook 22 of auxiliary hoist 24 may be disengaged from the hooking link. During this time, however, the hooking link remains in the outwardly projecting, generally horizontal full line position shown in FIG. 2 where it can come into engagement with fixed structures. For example, such ladles are frequently lowered onto and lifted from a supporting structure where limited clearance is provided. As can be readily seen from FIGS. 2-5, if the hooking link 42 engages any obstruction during downward movement, it will simply be pivoted about shaft 36 to the upper position shown in FIG. 2 until the obstruction is cleared. Since the hooking link 42 pivots freely, the ladle is not disturbed and molten metal or slag is not spilled as a result of the link assembly striking an obstruction.

When a ladle embodying the invention is being lifted and the hooking link strikes an obstruction, it is free to pivot downward about the axis of shaft 36. During such downward pivotal movement, roller 56 acts on the surface 78 of counterweight 68 to raise the counterweight to the elevated position shown in broken lines in FIG. 2. Again, when the hooking link clears the obstruction, it is returned to the full line substantially horizontal position shown in FIG. 2, this time by influence of the counterweight 68 acting through roller 56.

Bracket plates 26, 28 have their top edges 80 inclined downwardly and outwardly with respect to the ladle wall 30 and their bottom edges 82 inclined upwardly and outwardly from the bottom of the ladle. A top cover plate 84 extends between and is rigidly joined as by welding to inclined top edges 80. The angle of inclination of plate 84 and the thickness of the plate enable it to act as a continuous cam surface to effectively swing the ladle and its contents laterally on the hoist line of main hoist 16 when the rigid structure of the tilting lug assembly encounters an obstruction during lifting. Plate 84 also acts as a shield to prevent any spilled metal or slag from encountering the moving elements of the tilting lug assembly.

The upwardly and outwardly inclined bottom edges 82 of bracket plates 26, 28 also are designed to act as cam surfaces in the event the rigid structure of the tilting lug assembly encounters an obstruction during lowering of the ladle. The bottom edge portions of plates 26, 28 are also reinforced by two plates 86, 88 extending between and welded to the two gussets adjacent their bottom end portions. As seen in FIG. 2, plate 86 is inclined upwardly and outwardly to act as a cam surface when engaging an obstruction during lowering.

While a preferred embodiment of the invention has been disclosed and described in detail, it should be understood that the invention is not so limited but rather that it is intended to include all embodiments which would be apparent to one skilled in the art and which come within the spirit and scope of the invention.

What is claimed:

1. In a metallurgical ladle having a bottom, an upwardly extending sidewall, trunion means for supporting the ladle for tilting movement about a horizontal trunion axis, and ladle tilting lug means mounted on the ladle sidewall in position to be engaged and lifted by a crane hook for tilting the ladle about its trunion axis, the improvement wherein said tilting lug means comprises, elongated hooking link means having one end portion permanently mounted on said sidewall for limited pivotal movement about a fixed pivot axis, support bracket means rigidly mounted on said sidewall near said bottom and at a circumferential location substantially 90° from said trunion axis, said support bracket means including pivot means engaging and pivotally mounting said one end of said hooking link means for limited pivotal movement about said pivot axis, said pivot axis extending generally horizontally and in generally parallel relation to said trunion axis, said hooking link means having an open hooking eye at its other end for engagement by a crane hook to apply a tilting force through said hooking link and pivot means to tilt the ladle about said trunion axis, biasing means normally retaining said hooking link in a substantially horizontal position whereby said hooking eye is normally maintained at a position spaced outwardly from said sidewall for engagement by a crane hook, said hooking link being freely pivotable about said pivot axis in an upward direction upon application thereto of an upwardly directed force and being pivotable about said pivot axis downward from said generally horizontal position against said biasing means upon application thereto of a downward force.

2. The invention defined in claim 1 wherein said support bracket means comprises a pair of laterally spaced generally parallel vertically extending plates rigidly mounted on said sidewall, and wherein said pivot means comprises generally horizontally extending shaft means supported by said plates in fixed outwardly spaced relation to said sidewall.

3. The invention defined in claim 2 wherein said hooking link means is supported for movement about said pivot axis by gravity to move said hooking eye in a downward direction, and wherein said biasing means normally retains said hooking link means against movement by gravity about said pivot axis below said generally horizontal position in the absence of a downward force applied to said hooking link means overcoming said biasing means.

4. The invention defined in claim 3 wherein said biasing means comprises counterweight means mounted on said bracket means in position engaging said hooking link means in said generally horizontal position and means supporting said counterweight means for limited upward sliding movement on said bracket means by said hooking link means upon application of a downward force thereto, said counterweight means being operable to return said hooking link means to said generally horizontal position when such downward force is removed from said hooking link means.

5. The invention defined in claim 2 wherein said bracket means comprises upper and lower cam surfaces, said upper cam surface extending in a downwardly and outwardly inclined direction from said sidewall and said lower cam surface extending in an upward and outward direction from said sidewall, said cam surfaces being operable to laterally shift said ladle upon engagement with a rigid obstruction during raising or lowering of the ladle.

6. The invention defined in claim 5 wherein said upper cam surface comprises a downwardly and outwardly inclined cover plate member extending over and rigidly welded to said pair of plates, said cover plate member acting as a shield protecting said counterweight means and said shaft means from contact by molten metal or slag spilled from said ladle.

7. The invention defined in claim 6 wherein said hooking link means is supported for pivotal movement by gravity to move said hooking eye in a downward direction, and wherein said biasing means normally retains said hooking link means against pivotal movement by gravity below said generally horizontal position in the absence of a downward force applied to said hooking link means overcoming said biasing means.

8. The invention defined in claim 7 wherein said biasing means comprises counterweight means mounted on said bracket means in position engaging said hooking link means in said generally horizontal position and means supporting said counterweight means for limited upward sliding movement on said bracket means by said hooking link means upon application of a downward force thereto, said counterweight means being operable to return said hooking link means to said generally horizontal position when such downward force is removed from said hooking link means.

* * * * *

UNITED STATES PATENT AND TRADEMARK OFFICE

CERTIFICATE OF CORRECTION

PATENT NO. : 4,717,125
DATED : Jan. 5, 1988
INVENTOR(S) : John D. Ficke

It is certified that error appears in the above-identified patent and that said Letters Patent are hereby corrected as shown below:

Column 1, line 26, delete the entire line and insert the following therefor --hooking link having an eye projecting outwardly from--.

Column 2, line 50, delete "secticnal" and insert --sectional--.

Signed and Sealed this
Seventh Day of June, 1988

*Attest:*

DONALD J. QUIGG

*Attesting Officer*

*Commissioner of Patents and Trademarks*